US008374535B2

(12) United States Patent
Foster et al.

(10) Patent No.: US 8,374,535 B2
(45) Date of Patent: Feb. 12, 2013

(54) PIVOTING END CAP FOR A FUSER MODULE OF AN IMAGE FORMING DEVICE

(75) Inventors: Larry Steven Foster, Lexington, KY (US); Paul Douglas Horrall, Lexington, KY (US); David Erwin Rennick, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 310 days.

(21) Appl. No.: 12/651,084

(22) Filed: Dec. 31, 2009

(65) Prior Publication Data

US 2011/0158691 A1 Jun. 30, 2011

(51) Int. Cl.
*G03G 15/20* (2006.01)

(52) U.S. Cl. ..... 399/329

(58) Field of Classification Search ..... 399/329
See application file for complete search history.

(56) References Cited

U.S. PATENT DOCUMENTS

2006/0147231 A1* 7/2006 Aruga et al. ..... 399/329

FOREIGN PATENT DOCUMENTS

JP 2003295642 A * 10/2003
JP 2006003695 A * 1/2006

OTHER PUBLICATIONS

Kobayashi et al. (JP 2003-295642 A) JPO Machine Translation.*

* cited by examiner

*Primary Examiner* — David Gray
*Assistant Examiner* — Erika J Villaluna

(57) ABSTRACT

A fuser module of an image forming device including a pivot able end cap and a movable entry guide attached therein. The movable entry guide moves according to the pivoting end cap to ensure reduced positional variability within the fuser module. The pivoting end cap also has a wheel to axle ratio of about 18:1 to ensure reduced force variability within the fuser module.

21 Claims, 5 Drawing Sheets

PIVOTING END CAP FOR A FUSER MODULE OF AN IMAGE FORMING DEVICE

BACKGROUND OF THE INVENTION

1. Field of the Invention

The present invention relates generally to an image forming device having a fuser module and particularly to a fuser module that reduces force variability and positional variability within the fuser module.

2. Description of the Related Art

In an electro photographic image forming device such as a laser printer, an image forming unit transfers a toner image to a media sheet. After the toner image is transferred to the media sheet, the media sheet moves to a fuser module that applies heat and pressure on the media sheet in order to fuse the toner image to the media sheet.

The fuser module generally includes a backup roll, a fuser belt, and at least one heater. The backup roll and the fuser belt form a nip that is heated by the heater. When the media sheet enters the nip, it is gripped between the roller and the belt and is driven along the media path as the back-up roll and the fuser belt rotate, thereby fusing the toner image to the media sheet by the application of heat and pressure and eventually directing the media sheet out of the imaging apparatus. Typically, an entry guide is disposed upstream from the nip to guide the media sheet towards the nip.

An example of a conventional fuser module 10 is illustrated in FIG. 1. The fuser module 10 is placed between a first side frame 12 and a second side frame (not shown). The fuser module 10 includes a backup roll 14, a fuser belt 16, and a nip 18 formed by the backup roll 14 and the fuser belt 16. One end of the fuser belt 16 is covered by an end cap 20. The end cap 20 is mounted in a slot 22 formed in the side frame 12 of the image forming device and is held against the side frame 12 by a spring 24. The end cap 20 slides within the slot 22 based upon variation of the position of the nip 18 (shown by an arrow). A stationary entry guide 26 located upstream from the nip 18 is attached to the side frame 12 independent of the end cap 20 and guides the media sheet towards the nip 18 for fusing the toner image to the media sheet.

The position of the nip 18 often varies (shown by the arrow) due to several factors, such as wearing of the backup roll 14, thermal expansion of the backup roll 14, and variation in the media sheet thickness. However, a fuser module with the above geometry is unable to adjust itself in response to the above variations, thereby resulting in print defects.

For example, when the nip location varies (as shown by the arrow) due to the above reasons, the end cap 20 slides within the slot 22, thereby compressing or decompressing the spring 24 to accommodate for the nip location variation. Due to the compression and decompression of the spring 24, a large frictional force is developed between the end cap 20 and the side frame 12 of the image forming device around the slot 22. Also, the frictional force that is generated around the slot 22 directly affects the pressure that is maintained at the nip 18 in part due to a 1:1 aspect ratio (ratio of width to height) of the end cap 20. In other words, a considerable amount of the generated frictional force is deducted from the pressure that is maintained at the nip 18 and leads to application of decreased pressure on the media sheet passing through the nip 18. This relatively large force variation at the nip 18 causes inadequate fusing of the toner image to the media sheet resulting in compromised print quality.

Further, the stationary entry guide 26 that is fixed to the side frame 12 is independent of the movement of the nip 18, as well as the end cap 20. Also, a tip 28 of the entry guide 26 is placed at a certain distance from the nip 18. Thus, as the nip location varies due to the above reasons, the stationary entry guide 26 fails to adjust itself accordingly and the gap between the tip 28 of the entry guide 26 and the nip 18 increases, resulting in decreased media control. Consequently, this results in positional variation in the fuser module.

The introduction of the above-mentioned positional and force variability in the fuser module causes print defects, paper jams, belt skew, treeing, and smudging of the image on a media sheet passing through the nip. Thus, there is a need for a fuser module that addresses at least some of the above problems.

SUMMARY OF THE INVENTION

Disclosed herein is a fuser module for fixing a toner image to a media sheet in an image forming device including a backup roll, a fuser belt extending between two ends and engaging with the backup roll to form a nip, a movable entry guide disposed in a spaced relationship with the nip, and at least one pivot able end cap enclosing at least a portion of one end of the fuser belt and attached to the movable entry guide, the at least one pivot able end cap capable of maintaining the movable entry guide in the spaced relationship with the nip.

In some embodiments, the fuser belt rotates about a fuser axis, the fuser axis being disposed at a first distance from a pivot center of the at least one pivot able end cap.

In another embodiment, the wheel to axle ratio of the at least one pivot able end cap is about 18:1.

In yet another aspect of the invention, disclosed is an image forming device including an image transfer station adapted to transfer a toner image to a media sheet, and a fuser module located downstream the image forming unit and configured to fuse the toner image to the media sheet, the fuser module including, a backup roll, a fuser belt extending between two ends and engaging with the backup roll to form a nip, the fuser belt rotating about a fuser axis, a movable entry guide disposed in a spaced relationship with the nip, and at least one pivot able end cap enclosing at least a portion of one end of the fuser belt and attached to the movable entry guide, the at least one pivot able end cap pivoting about a pivot center that is disposed at a first distance from the fuser axis, the at least one pivot able end cap capable of maintaining the movable entry guide in the spaced relationship with the nip.

In yet another aspect of the invention, disclosed herein is a fuser module for fixing a toner image to a media sheet in an image forming device including a backup roll, a fuser belt extending between two ends and engaging with the backup roll to form a nip, the fuser belt rotating about a fuser axis, at least one pivot able end cap enclosing at least a portion of one end of the fuser belt and pivoting about a pivot center defined by a shaft having a radius, the pivot center being disposed at a first distance from the fuser axis and at a second distance from the nip, a wheel to axle ratio of the at least one pivot able end cap defined by ratio between the second distance and the radius of the shaft being about 18:1, and a movable entry guide disposed in a spaced relationship with the nip and attached to the at least one pivot able end cap, the at least one pivot able end cap capable of maintaining the movable entry guide in the spaced relationship with the nip.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
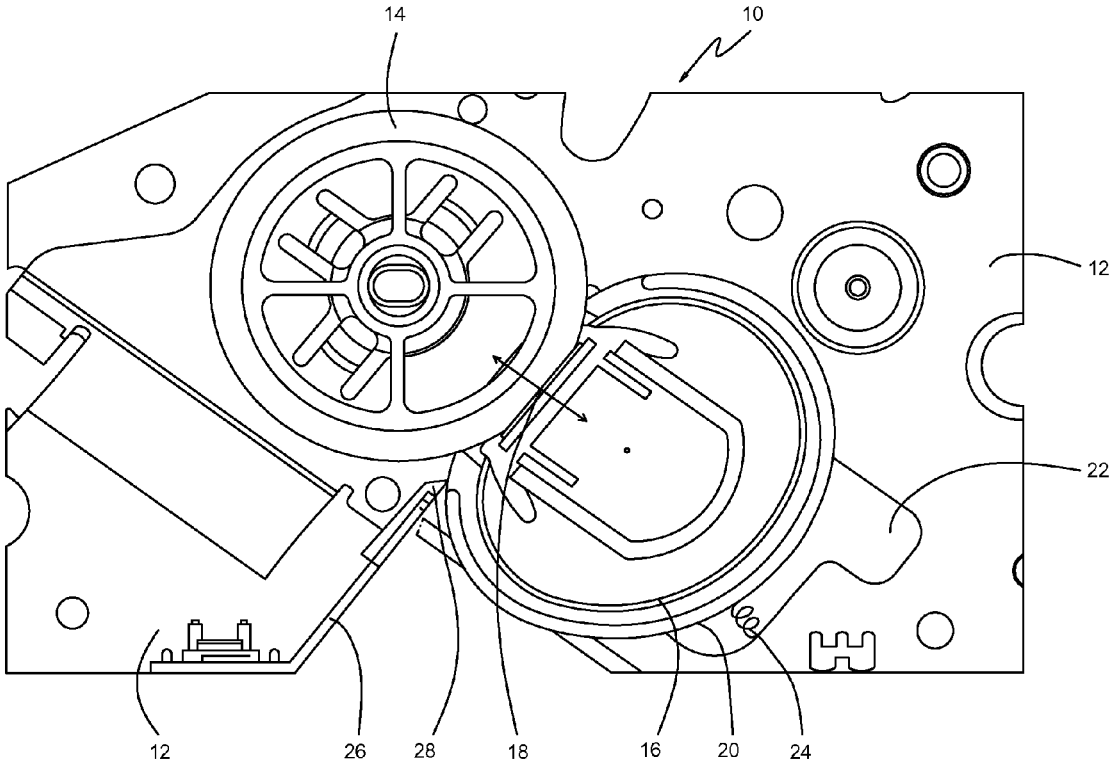
FIG. 1 (PRIOR ART)
FIG. 1 illustrates a side elevational view of a prior art fuser module.

Reference will now be made in detail to the exemplary embodiment(s) of the invention as illustrated in the accompanying drawings. Whenever possible, the same reference numerals will be used throughout the drawings to refer to the same or like parts.

Figure 2:
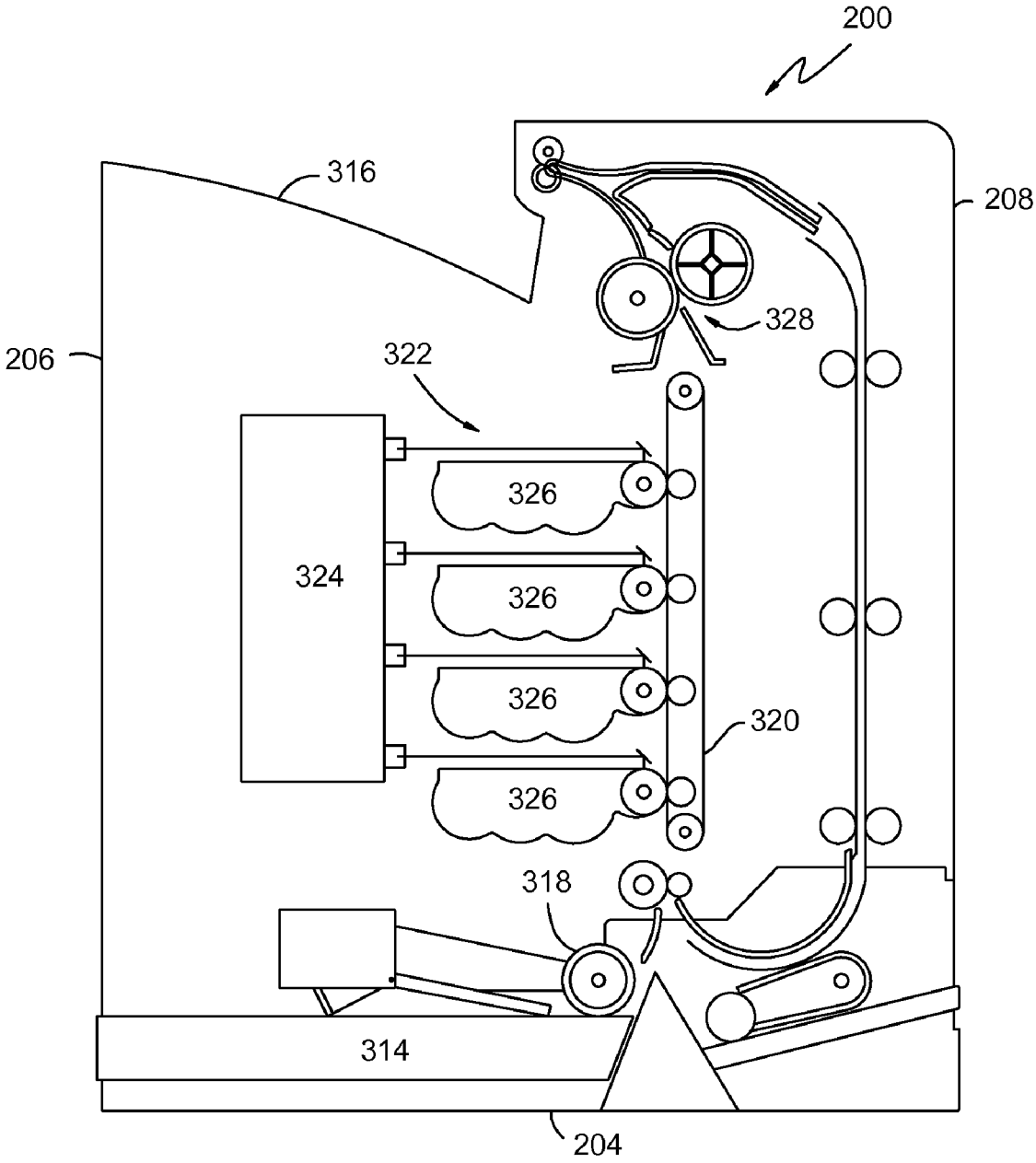
FIG. 2 illustrates a side elevational view of internal components of an image forming device.

FIG. 2 illustrates an illustration of the internal components of an image forming device 200. The image forming device 200 includes a media input tray 314 and a media output area 316. The media input tray 314 is disposed at the bottom 204 of the body, and contains a stack of media sheets on which the image forming device 200 will form images. A pick mechanism 318 moves a top-most media sheet from the media stack to a media path. A media transport belt 320 disposed downstream from the media stack moves the media sheet past a plurality of image forming units 322. Color image forming devices typically have four image forming units 322 for printing with cyan, magenta, yellow, and black toner on the media sheets. An optical scanning device 324 forms a latent image on a photoconductive member of the image forming units 322. The latent image is developed using toner supplied by respective developer units 326 of each image forming unit 322 and the developed image is subsequently transferred onto the media sheet that is carried past the image forming units 322 by the media transport belt 320. The media sheet carrying the loose toner image is then moved through a fuser module 328 to fix the toner to the media sheet by applying heat and pressure to the media sheet.

Figure 3:
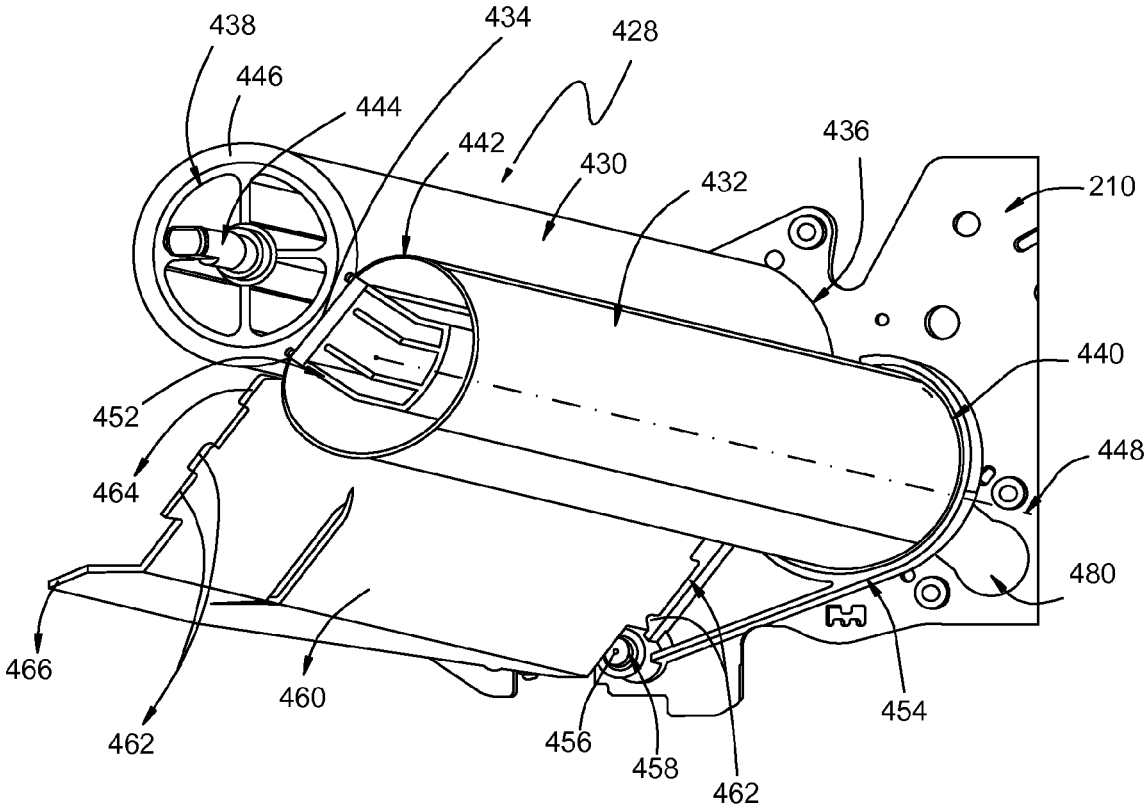
FIG. 3 illustrates a perspective view of one embodiment of a fuser module according to an exemplary embodiment of the present invention.

FIG. 3 illustrates one embodiment of a fuser module 428 according to an exemplary embodiment of the present invention. The fuser module includes a backup roll 430 and a fuser belt 432, that form a nip 434. Both the backup roll 430 and the fuser belt 432 are hollow and cylindrical in structure, each having two ends 436, 438 and 440, 442, respectively, extending between the first side 210 and the second opposing side 212 (shown in FIG. 5) of the image forming device 200. The backup roll 430 has a fixed shaft 444 extending across its length. A rotating portion 446 of the backup roll 430 rotates about the fixed shaft 444. The fuser belt 432 also rotates about a fuser axis 448. A heater (not shown), enclosed by a heater housing 452, is located inside the hollow of the fuser belt 432 in order to internally heat the fuser belt 432 at the nip 434. At least one end 440 of the fuser belt 432 is enclosed by an end cap 454. An entry guide 460 is mounted on the end cap 454 through slots and grooves 462 located in the end cap 454 as well as the entry guide 460.

Figure 4:
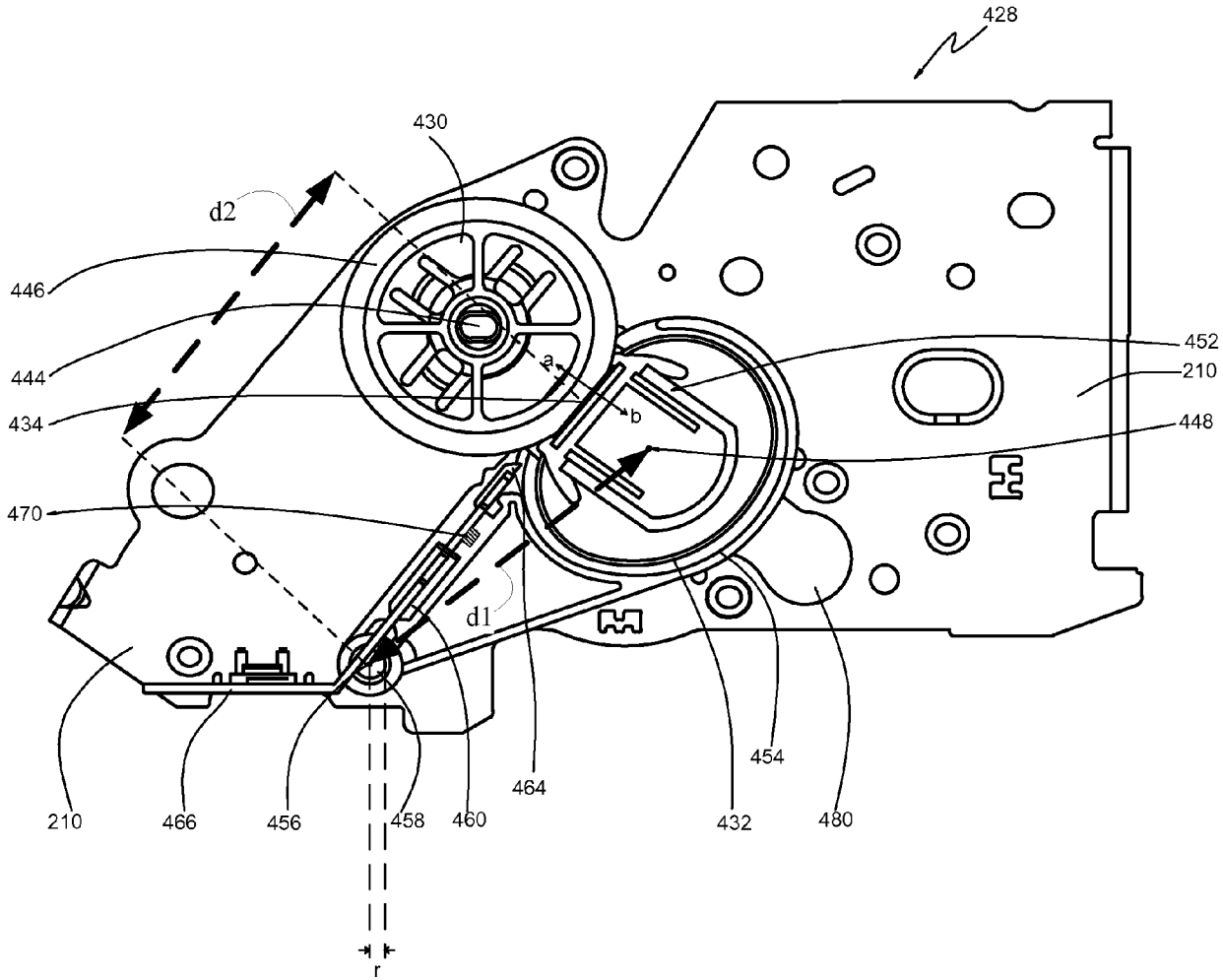
FIG. 4 illustrates a side elevational view of the fuser module of FIG. 3.

FIG. 4 illustrates a side elevational view of the fuser module 428 showing the nip 434 formed by the backup roll 430 and the fuser belt 432. The end cap 454 pivots about a pivot center 456 that is defined by a shaft 458. The shaft 458 has a fixed radius r. The geometry of the end cap 454 is such that the pivot center 456 of the end cap 454 is at a first distance d1 from the fuser axis 448 and at a second distance d2 from the nip 434. Further, the ratio between the second distance d2 and radius r of the shaft 458 is about 18:1. This ratio of 18:1 defines the wheel to axle ratio of the end cap 454. The radius r of the shaft 458 in the present invention is about 2.5 mm, while the distance d2 between the pivot center 456 of the end cap 454 and the nip 434 is about 45 mm, thereby making the wheel to axle ratio of the end cap 454 to be (45/2.5) or about 18:1.

The end cap 454 is mounted in a slot 480 on one of the side frames 210 of the image forming device 200 and slides within the slot 480 while pivoting about its pivot center 456 when the nip 434 moves (shown by arrow a-b). As already discussed above, the nip 434 moves due to various factors like wearing of the backup roll 430, thermal expansion of the backup roll 430, and variation in the media sheet thickness, leading to positional variation of the nip 434. Thus, when the diameter of the backup roll 430 decreases due to wearing, the nip 434 moves forward, toward direction 'a', leading to pivoting of the end cap 454 in an counterclockwise direction, and when the diameter of the backup roll 430 increases due to thermal expansion, the nip 434 moves backward, towards direction 'b', leading to pivoting of the end cap 454 in a clockwise direction.

The entry guide 460 is mounted on the end cap 454 such that when the end cap 454 pivots about its pivot center 456, the entry guide 460 moves along with the end cap 454. One end 464 of the entry guide 460 that lies closer to the nip 434 is placed at a certain gap from the nip 434, thereby having a spaced relation with the nip 434. The other end 466 of the entry guide 460 that lies away from the nip 434 is attached to the side frame 210 of the image forming device. When the end cap 454 pivots due to movement of the nip location 434, the entry guide 460 that is attached to the end cap 454 also rotates accordingly, thereby keeping the gap between the one end 464 of the entry guide 460 and the nip 434 constant. Therefore, the present geometry of the fuser module, and more particularly, the geometry of the end cap addresses the problem of positional variation within the fuser module effectively.

The present invention also replaces the sliding end cap having a 1:1 aspect ratio, as seen in the prior art end cap geometry (illustrated in FIG. 1), with the pivot able end cap 454 having a wheel to axle ratio of 18:1 to address the issue of force variability within the fuser module. As discussed with respect to the prior art fuser module geometry, the sliding end caps generated a relatively large amount of frictional force due to compression and decompression of the spring. The 1:1 aspect ratio of the sliding end cap resulted in the subtraction of a considerable amount of the generated frictional force directly from the pressure that is maintained at the nip, causing significant force variability at the nip. However, the present fuser module geometry eliminates the necessity of a spring, thereby removing the source that generated the relatively large and undesirable frictional force. As the end cap 454 now pivots about the pivot center 456, the frictional force is generated between the shaft 458 and the end cap region around the shaft 458. Since the frictional force is generated around the shaft 458 (having radius 2.5 mm), and the nip 434 is situated about 45 mm away from the shaft 458, the effect of the frictional force at the nip 434 is attenuated by a factor of 18, due to the 18:1 wheel to axle ratio of the end cap 454. Thus, with the present end cap geometry the force variability at the nip 434 is reduced by a significant amount and becomes more predictable.

FIG. 4 also shows a bubble sensor 470 mounted on the entry guide 460 and located upstream from the nip 434 and downstream from the image forming unit (not shown in FIG. 4). The bubble sensor 470 senses a bubble or loop formed in the media sheet while the media sheet is located between the image forming unit and the fuser module 428 and controls the bubble from attaining an undesirable size, thereby ensuring optimal print quality.

Figure 5:
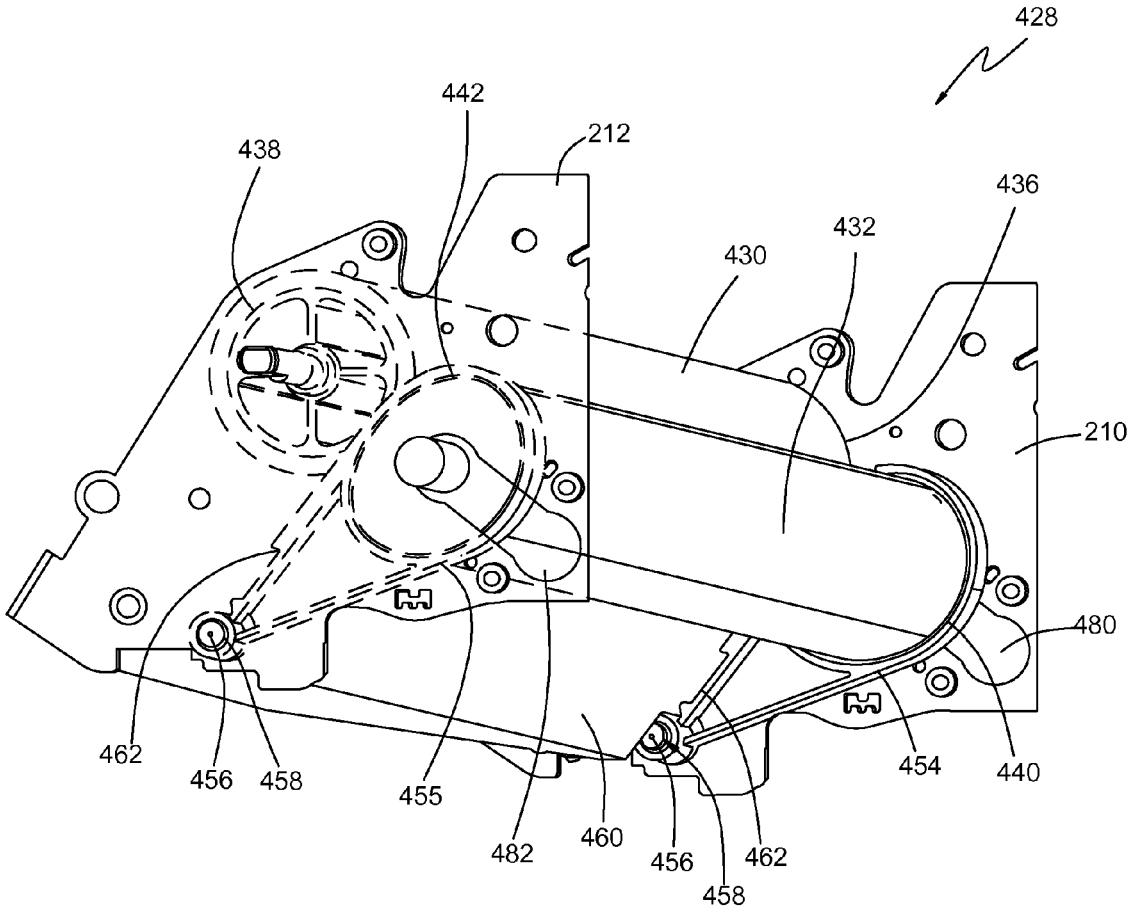
FIG. 5 illustrates a perspective view of a fuser module according to an exemplary embodiment of the present invention.

FIG. 5 illustrates another embodiment of the present invention where both ends 440, 442 of the fuser belt 432 are enclosed by end caps 454, 455, respectively. In that case, both the end caps 454, 455 pivot about the same shaft 458 that acts as the pivot center 456 for both the end caps 454, 455. Also, both the end caps 454, 455 have groove and slots 462 to allow the entry guide 460 to be mounted on them. The end caps 454, 455 are identical in structure except for the fact that while one end cap 454 is mounted in the slot 480 on the first side 210 of the image forming device, the other end cap 455 is mounted in another slot 482 on the second opposing side 212 of the image forming device. The shaft 458 extends between the first side 210 and the second opposing side 212 of the image forming device.

It should be noted that the pressure maintained at the nip 434 and the spaced relation of the one end 464 of the entry guide 460 relative to the nip 434 varies between different media sheets, different fuser modules, and different image forming devices. However, the fuser module according to the present invention ensures the consistency of the above two factors between various kinds of media sheets, fuser modules, and image forming devices, owing to the criticality of the above factors in a fuser module of an image forming device.

It will be apparent to those skilled in the art that various modifications and variations can be made to the present invention without departing from the spirit and scope of the invention. Thus, it is intended that the present invention cover the modifications and variations of this invention provided they come within the scope of the adapted claims and their equivalents.

What is claimed is:

1. A fuser module for fixing a toner image to a media sheet in an image forming device comprising:

a backup roll;

a heater assembly including a heater and heater housing therefor;

a fuser belt extending between two ends and engaging with the backup roll to form a nip, the fuser belt being rotatably disposed around the heater assembly such that the heater heats an inner surface of the fuser belt for providing heat to the nip;

a movable entry guide disposed in a spaced relationship with the nip; and at least one pivotable end cap enclosing at least a portion of one end of the fuser belt and attached to the movable entry guide, the at least one pivotable end cap maintaining the movable entry guide in the spaced relationship with the nip;

wherein the at least one pivotable end cap pivots about a pivot center, the pivot center being spaced from a rotational axis of the backup roll and a rotational axis of the fuser belt within the housing, at least a portion of the movable entry guide is disposed between the pivot center and the nip.

2. The fuser module of claim 1, wherein the spaced relationship is defined by a gap formed between one end of the movable entry guide and the nip, the one end of the movable entry guide being disposed adjacent to the nip.

3. The fuser module of claim 2, wherein the at least one pivotable end cap pivots between a first position and a second position such that the gap formed between the one end of the movable entry guide and the nip remains substantially constant.

4. The fuser module of claim 2, wherein the one end of the movable entry guide pivots about the pivot center.

5. The fuser module of claim 1, wherein the at least one pivotable end cap pivots about the pivot center, the pivot center being defined by a shaft having a radius, the shaft being spaced from the rotational axis of the backup roll and the rotational axis of the fuser belt within the heater housing.

6. The fuser module of claim 5, wherein the fuser belt rotates about a fuser axis, the fuser axis being disposed at a first distance from the pivot center of the at least one pivotable end cap.

7. The fuser module of claim 5, wherein the pivot center is disposed at a second distance from the nip.

8. The fuser module of claim 7, wherein a ratio between the second distance and the radius of the shaft defines a wheel to axle ratio of the at least one pivotable end cap.

9. The fuser module of claim 1, wherein the at least one pivotable end cap is pivotably mounted on a side frame of the imaging apparatus.

10. The fuser module of claim 1, wherein the fuser module comprises two pivotable end caps, each pivotable end cap enclosing at least a portion of respective ends of the fuser belt.

11. The fuser module of claim 10, wherein each pivotable end cap is pivotably mounted to side frames of the imaging apparatus.

12. A fuser module for fixing a toner image to a media sheet in an image forming device comprising:

a backup roll;

a fuser belt extending between two ends and engaging with the backup roll to form a nip;

a movable entry guide disposed in a spaced relationship with the nip; and at least one pivotable end cap enclosing at least a portion of one end of the fuser belt and attached to the movable entry guide, the at least one pivotable end cap maintaining the movable entry guide in the spaced relationship with the nip;

wherein the at least one pivotable end cap pivots about a pivot center, the pivot center being defined by a shaft having a radius, the pivot center is disposed at a second distance from the nip;

wherein a ratio between the second distance and the radius of the shaft defines a wheel to axle ratio of the at least one pivotable end cap, and wherein the wheel to axle ratio of the at least one pivotable end cap is about 18:1.

13. An image forming device comprising:

an image forming unit for forming a toner image to a media sheet; and a fuser module located downstream the image forming unit and configured to fuse the toner image to the media sheet, the fuser module comprising:

a backup roll;

a heater assembly including a heater and heater housing therefor;

a fuser belt extending between two ends and engaging with the backup roll to form a nip, the fuser belt rotating about a fuser axis, the fuser belt being disposed around the heater assembly such that the heater heats an inner surface of the fuser belt as the fuser belt rotates about the heater housing for heating the nip;

a movable entry guide disposed in a spaced relationship with the nip; and at least one pivotable end cap enclosing at least a portion of one end of the fuser belt and attached to the movable entry guide, the at least one pivotable end cap pivoting about a pivot center that is disposed at a first distance from the fuser axis and at a second distance from the nip, the at least one pivotable end cap maintaining the movable entry guide in the spaced relationship with the nip;

wherein the pivot center of the at least one pivotable end cap is defined by a shaft having a radius, the shaft being spaced from a rotational axis of the backup roll and the fuser axis, a ratio between the second distance and the radius of the shaft defines a wheel to axle ratio of the at least one pivotable end cap, and the wheel to axle ratio of the at least one pivotable end cap is about 18:1.

14. The imaging apparatus of claim 13, wherein the spaced relationship is defined by a gap formed between one end of the movable entry guide and the nip, the one end of the movable entry guide being disposed adjacent to the nip.

15. The imaging apparatus of claim 14, wherein the one end of the movable entry guide pivots about the pivot center.

16. The imaging apparatus of claim 13, wherein the fuser module comprises two pivotable end caps, each pivotable end cap enclosing at least a portion of respective ends of the fuser belt.

17. A fuser module for fixing a toner image to a media sheet in an image forming device comprising:

a backup roll;

a fuser belt extending between two ends and engaging with the backup roll to form a nip, the fuser belt rotating about a fuser axis;

at least one pivotable end cap enclosing at least a portion of one end of the fuser belt and pivoting about a pivot center defined by a shaft having a radius, the pivot center being disposed at a first distance from the fuser axis and at a second distance from the nip, a wheel to axle ratio of the at least one pivotable end cap defined by ratio between the second distance and the radius of the shaft being about 18:1; and a movable entry guide disposed in a spaced relationship with the nip and attached to the at least one pivotable end cap, the at least one pivotable end cap maintaining the movable entry guide in the spaced relationship with the nip.

18. A fuser module for fixing a toner image to a media sheet in an image forming device comprising:

a backup roll;

a heater assembly including a heater and housing for the heater;

a rotatable fuser belt extending between two ends and engaging with the backup roll to form a nip, the heater assembly being disposed within the fuser belt so as to heat an inner surface thereof for heating the nip; and an entry guide disposed in a spaced relationship with the nip;

the nip and entry guide being coupled to each other and rotating together about an axis that is spaced from a rotational axis of the backup roll and a rotational axis of the fuser belt, a distance between the nip and the entry guide being substantially constant.

19. The fuser module of claim 18, further comprising at least one end cap enclosing at least a portion of one end of the fuser belt and being attached to the entry guide, the at least one end cap pivoting about the axis about which the nip and the entry guide rotate, the at least one end cap maintaining the entry guide in the spaced relationship with the nip.

20. The fuser module of claim 19, wherein the pivot center is disposed at a second distance from the nip and defined by a shaft having a radius, and a wheel to axle ratio of the at least one pivotable end cap is defined by ratio between the second distance and the radius of the shaft being about 18:1.

21. A fuser module for fixing a toner image to a media sheet in an image forming device comprising:

a backup roll;

a heater assembly including a heater and heater housing therefor;

a fuser belt extending between two ends and engaging with the backup roll to form a nip, the fuser belt being rotatably disposed around the heater assembly such that the heater heats an inner surface of the fuser belt for providing heat to the nip;

a movable entry guide disposed in a spaced relationship with the nip; and at least one pivotable end cap enclosing at least a portion of one end of the fuser belt and attached to the movable entry guide, the at least one pivotable end cap maintaining the movable entry guide in the spaced relationship with the nip;

wherein the at least one pivotable end cap pivots about a pivot center, the pivot center being spaced from a rotational axis of the backup roll and a rotational axis of the fuser belt within the housing, the spaced relationship is defined by a gap formed between one end of the movable entry guide and the nip, the one end of the movable entry guide being disposed adjacent to the nip, and the at least one pivotable end cap pivots between a first position and a second position such that the gap formed between the one end of the movable entry guide and the nip remains substantially constant.

* * * * *